United States Patent [19]

Leezer

[11] 4,093,073

[45] June 6, 1978

[54] FIBER CAN DOUGH PACKAGE WITH KRAFT PAPER BODY AND PEELABLE LABEL

[75] Inventor: James R. Leezer, Minneapolis, Minn.

[73] Assignee: The Pillsbury Company, Minneapolis, Minn.

[21] Appl. No.: 739,913

[22] Filed: Nov. 8, 1976

Related U.S. Application Data

[63] Continuation-in-part of Ser. No. 561,132, Mar. 24, 1975, abandoned.

[51] Int. Cl.[2] ..... B65D 5/54

[52] U.S. Cl. ..... 206/606; 206/613; 206/633; 206/830; 229/4.5

[58] Field of Search ..... 229/51 BD, 51 WB, 48 SB, 229/48 T, 4.5; 206/484, 498, 830, 606, 613, 633

[56] References Cited

U.S. PATENT DOCUMENTS

| | | | |
|---|---|---|---|
| 2,099,166 | 11/1937 | Inman et al. | 229/51 WB |
| 2,747,788 | 5/1956 | Tilly | 229/51 WB |
| 3,113,714 | 12/1963 | Stump | 229/51 BP |
| 3,182,891 | 5/1965 | Ecklund et al. | 229/51 BP |
| 3,257,228 | 6/1966 | Reed | 229/48 SB |
| 3,608,707 | 9/1971 | Miller | 229/48 SB |
| 3,827,625 | 8/1974 | Miller | 229/48 SB |
| 3,938,659 | 2/1976 | Nardwell | 229/51 WB |
| 3,940,496 | 2/1976 | Turpin et al. | 229/51 BP |

*Primary Examiner*—William Price
*Assistant Examiner*—Joseph M. Moy
*Attorney, Agent, or Firm*—James V. Harmon; Michael D. Ellwein; Mart C. Matthews

[57] ABSTRACT

A dough package is described that comprises a fiber can containing dough in which the can wall is composed of a body layer of kraft paper having a helically disposed butt joint defined by its mating side edges to which is releasably bonded a relatively thin lightweight label. The label is releasably bonded to the underlying kraft paper by means of a peelable adhesive layer which functions in one of two ways. In the first, the adhesive functions as a releasable layer interposed between the body layer and the unexposed surface of the label. This layer is released from the label and remains in place when the label is peeled back. In the second method the peelable adhesive layer ruptures or splits as the label is lifted although a small fraction e.g. 10% of the surface kraft fibers may be pulled out when the label is removed. The term "peelable adhesive" herein refers both to adhesives that split and those that separate from the label when the label is lifted.

7 Claims, 4 Drawing Figures

FIBER CAN DOUGH PACKAGE WITH KRAFT PAPER BODY AND PEELABLE LABEL

This is a continuation in part of application Ser. No. 561,132 filed March 24, 1975 and bearing the same title now abandoned.

The field of the invention is fiber dough cans.

THE PRIOR ART

The cylinder board presently being used as the body stock layer of peel open fiber cans for fresh dough products is sometimes referred to as single news vat line cylinder board. The cylinder board layer is roughly 0.026 inches thick and a hundred pounds basis weight. The structure of cylinder board is unique since it provides a high wet strength and has on its surface relatively short fibers of newsprint which are torn out when the label bonded to the surface of the board is lifted and removed for the purpose of opening the can. The fibers can be seen on the label as a thin dark layer. The supply sources of cylinder board are relatively limited and even though it is less expensive than kraft paper on a tonnage basis, its bursting and tensile strength is less for sheets of equal thickness. Accordingly, natural kraft paper of only 0.020 inches in thickness and 70 pounds per 1,000 square feet has the equivalent strength of 0.026 inch cylinder board. Moreover, because the cylinder board is made from recycled paper, its composition is often difficult to ascertain and contamination is a potential problem, an important consideration in the packaging of food with which the present invention is primarily concerned.

Heretofore it has been thought essential to employ cylinder board in fresh dough containers in spite of its shortcomings because of its unique ability to allow removal of the label by peeling it away from the underlying cylinder board as described above. Kraft paper does not have easy-to-remove fibers on its surface and thus cannot be substituted for the cylinder board. In prior fiber cans, peeling off the label opened the cans. Where removal of the label is not a requirement, kraft paper is traditionally used as the body stock material because it is superior to cylinder board in both tensile and burst strength. Examples are U.S. Pat. Nos. 3,510,050 and 3,165,985. However, neither of the containers described in these patents is at present in widespread commercial use as far as can be determined and in neither case is the label removed from the body wall during opening.

The major obstacle using kraft liner board up to the time of the present invention has been an inability to find a way to achieve consistent and reliable peeling back of the label material while at the same time providing sufficiently strong adhesion to keep the label bonded in place until removed by hand.

When a label is glued to kraft paper, a bridge or membrane of delaminated paper of ten remains across the butt joint in the cylinder board layer which prevents reliable opening of the can. At other times the kraft paper may peel off irregularly (delaminate) and a considerable amount of force may be necessary to remove the label which produces an erratic uncontrolled patter of torn paper. Accordingly, a primary objective of the invention is to provide a fresh dough container of the type described having a kraft paper body layer, a removable label with a provision for allowing the label to be consistently and reliably removed to expose the butt joint defined by the mating edges of the underlying kraft paper without the label tearing and deliminating so as to leave a membrane of paper over the butt joint.

A problem in the application of adhesive which allows a layer of adhered sheet material to be peeled away is the requirement in the present invention for sufficient instant adhesive bond strength to enable the composite tube as it is formed to pass through the forming and cutting system without coming apart. This strength is required in the first three seconds after the layers come together in the winding operation.

In the course of development of the present invention, attempts were made to control the surface of the kraft paper to regulate its adhesion to the overlying label. These attempts, however, met with failure. In the present development, adhesives known as low peel strength high sheer strength adhesive were also tried. They were also unsuccessful in the present application because they did not have enough strength to hold the can together through the winding and cut-off operation.

THE OBJECTS

The major objects of the invention are: a) to provide an improved fresh dough can having a body layer formed from kraft paper with a provision to facilitate consistent and reliable removal of the label from the kraft body layer, b) reduced cost due to an increase in yield of the kraft body compared with that of a cylinder board can body, a reduction for example, on the order of about 25% of the cost of the container body, c) a package which is suited for manufacturing using existing equipment, d) a package which is reliable in operation and rugged in construction, e) an increase in the crimping strength between the can ends to the can sidewall to improve the air burst strength without the requirement of a flanged locking seam between the metal and the can wall, f) the ability to use a less expensive label than the paper and foil laminate traditionally used, g) the provision of an improved fresh dough package in which the label is better suited for printing than the laminative foil and paper presently used, improving the quality of reproduction, h) the provision for allowing removal of the label as easily as in previous cans but reliably maintaining the label in place during the life of the product, i) the ability to employ readily available materials, j) a container which is adapted for use with a variety and grades of kraft paper, k) the bond between the label and the body layer has enough instant strength to hold the can together through the winding and cut-off operation, l) a more specific object of one form of the invention is to provide a label with a specific surface treatment on its under side compatible with the adhesive used to bond the label to the can body.

THE FIGURES

SUMMARY OF THE INVENTION

Figure 1:
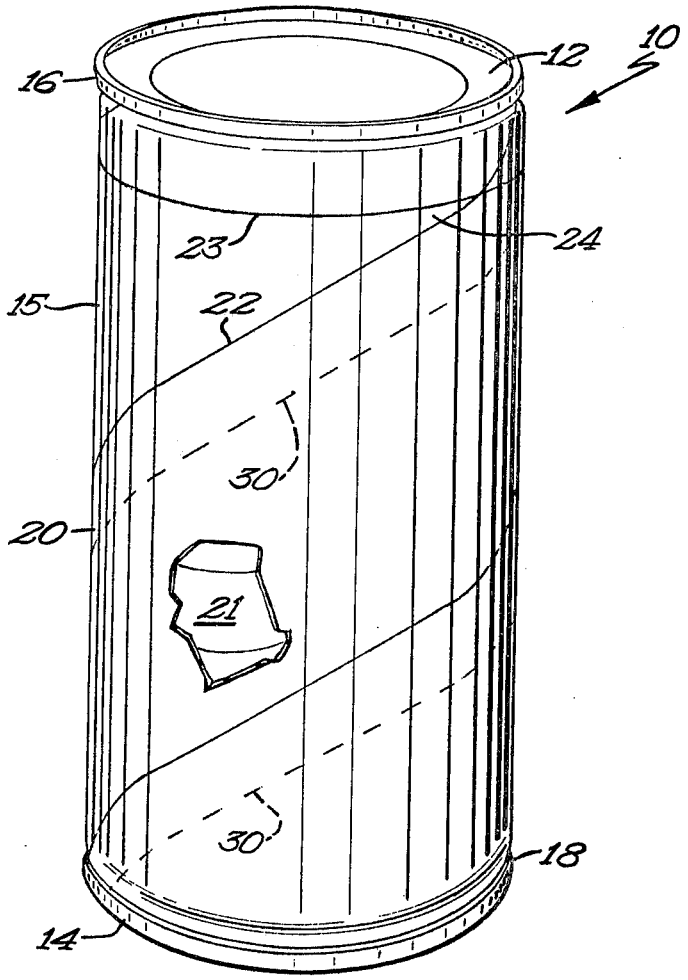
FIG. 1 is a perspective view of a dough package embodying the invention.

The dough package described comprises a fiber can in which a cylindrical can wall is composed of a body layer of kraft paper having helically disposed butt joint defined by the mating edges of the kraft paper. A helically disposed label is releasably bonded to the underlying kraft paper by means of a peelable adhesive layer which functions in one of two ways. In the first, the adhesive functions as a releasable layer interposed between the body layer and the unexposed surface of the label. This layer can be released from the label and remain in place when the label is peeled back or in the alternative, may remain adhered to the label and be released from the kraft layer. In the second method, the peelable adhesive layer ruptures or splits as the label is lifted although a small fraction e.g. 10% of the surface kraft paper fibers may be pulled out when the label is removed. The term "peelable adhesive" herein refers both to adhesives that split and those that separate from the label when the label is lifted.

In addition, a variety of different release materials can be applied between the kraft body and the peelable adhesive layer. Among them are organic compounds such as oils and waxes such as Acrawax C which is made by the Glyco Chemical Company of Greenwich, Connecticut, organic fluoride release agents and silicones, either alone or mixed with compatible waxes. These release materials may be present either as a continuous layer or as a pattern of dots or lines. In the second form of the invention in which the adhesive itself splits, the adhesive layer can comprise a variety of substances among which are clay coatings in which the clay layer itself splits as the label is peeled back or microcrystaline waxes which again split as the label is peeled off. Other frangible adhesive agents will be apparent to those skilled in the art.

The coating layers located in between the label and the body stock can be applied either to the body stock or to the label or to both. It is important that the peelable adhesive provide a sufficiently low peeling tensile force so that the label can be peeled back without tearing. In general, I have found that the peel strength of the bond between the label and the kraft body layer that is provided by the adhesive should be between about 0.10 and 0.50 and preferably between about 0.15 and 0.30 pounds per inch width. The exact peeling force, however, is not regarded to be as critical as is the consistency factor in opening, that is to say, the ability of the label to be consistently removed from the underlying body stock without rupturing or splitting along a plane parallel to its surface and without removing or delaminating the surface layer of the body stock. The required consistency of opening is provided in accordance with the present invention by means of a kraft body stock layer and the peelable adhesive or coating layer between the body layer and the label outlined above.

In the accomplishment of the foregoing and related ends, the invention then comprises the features hereinafter fully described and particularly pointed out in the claims, the following description setting forth in detail certain illustrative embodiments of the invention, these being indicative, however, of but a few of the various ways in which the principles of the invention may be employed.

DESCRIPTION OF THE PREFERRED EMBODIMENTS

Figure 2:
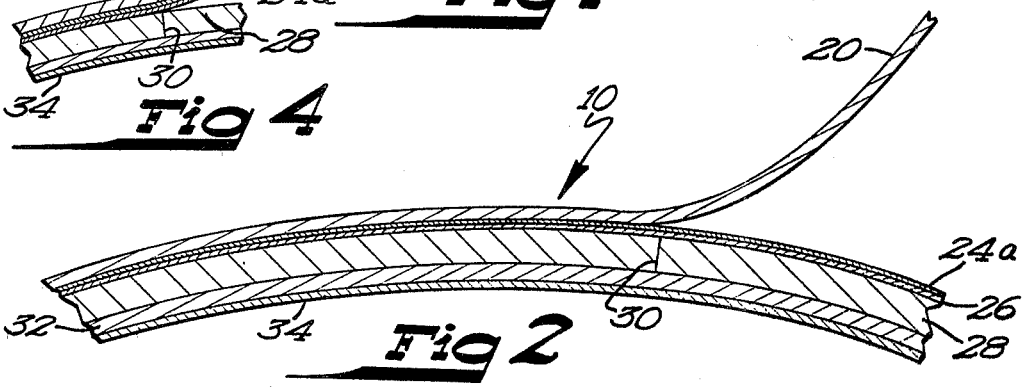
FIG. 2 is a partial horizontal cross sectional view of the can wall of FIG. 1.

Refer now to FIGS. 1 and 2 which illustrate one preferred form of the invention.

In FIG. 1 is a fresh dough package consisting of a can 10 having top and bottom circular sheet metal ends 12 and 14 respectively which are crimped or seamed to the ends of the can body 15 at 16 and 18 respectively. The can body 15 consists of a cylindrical tube which is formed from and comprises a label 20 wound helically upon and bonded to an underlying body layer 28 as described below. The dough 21 can be seen within the package 10. The label 20 has side edges which overlap slightly (usually by about an eighth of an inch) along a line designated 22 in FIG. 1. The label is cut entirely through and the underlying body stock layer 28 is cut partially through by a circumferentially extending circular cut 23 frequently referred to as a collar cut near one end of the can to define a tab 24 that serves as a means of lifting the label to unwrap it from the underlying body stock layer 28 as will be described below.

The body stock layer 28 comprises kraft paper at least about 0.010 inches thick and preferably about 0.015 to about 0.025 inches in thickness i.e. about 40 pounds to about 90 pounds per 1,000 square feet and is wound helically like the label. Its side edges meet to form a butt joint 30 defining a line of weakness in the wall of the container which permits the container to open abruptly along substantially its full length following removal of the label 20 as described below. There is no adhesive in the butt joint 30.

The label 20 can be constructed of a variety of materials such as paper, laminates, examplified by laminates of kraft paper and foil or plastic resinous materials. Plastic resin films are preferred. An outstanding film is a layer of polystyrene film. To the film 20 is applied a peelable coating **24*a*(FIG. 2). The peelable coating consists of a substance which will bond tenaciously to an adhesive but bonds relatively poorly to the plastic film 20. It is to be understood that in the present invention a small fraction, e.g. 10% or so of the fibers on the surface of the kraft paper body stock 28 may be removed when the label 20 is lifted. One suitable peelable material is a clay coating which may typically be less than about 0.005 inches thick and preferably less than about 0.001 inches thick. The clay coating can be prepared from a kaolin clay from a commercially available source, the clay having been mixed with water, agitated and washed for example by passing it through a hydro-separator, then decolorized by chemical bleaching with sodium hydrosulfite then settled and removed by filtration, extruded and dried, resuspended and defloculated. Most commercially available paper coating clays shipped after the above processing in railroad tank cars have a solids content of about 60–70% by weight, in an aqueous suspension. The clay coating has a low adhesive requirement when adhesive is used, roughly 10–25% for a starch base adhesive and 10–17 % for caseine. Thus, a typical formula using caseine comprises clay 45% by weight, caseine 15% by weight and water 40% by weight. When a starch base is used, a typical formula is 55% Kaolin clay, 10% starch base and 35% water. The clay coating 24*a* is applied to the label 20 by any suitable commercially available process, for example by roll coating. It should be clearly understood that the adhesion of the clay layer 24*a* to the label is less than the strength of the bond of the clay layer 24*a* to the adhesive 26**. The tubular body of the can composed of the body stock liner and label can be formed and cut, for example, as described in U.S. Pat. Nos. 2,793,126; 2,793,127 and 3,756,128 which are incorporated herein by reference.

The method of winding and cutting the tube per se is well known to those skilled in the art and does not in itself form a part of the invention. The adhesive 26 can comprise a resinous emulsion type adhesive such as a polyvinyl acetate water emulsion adhesive of the type commonly used in the packaging industry. These adhesives typically comprise: clay about 20%, water about 70%, polyvinyl acetate about 6% and polyvinyl alcohol about 4%. One suitable adhesive is no. PV3 by the H. B. Stuck Adhesive Company, Inc. of 520 Greenleaf Street, Fort Worth, Texas 76107.

Inside the body stock layer a liner composed of two plys 32 and 34 suitably bonded together prior to winding and composed of a helical strip which is securely bonded by means of adhesive (not shown) to the inside of the body stock 28 to form a barrier. The liner in this instance consists of a laminate of kraft paper 32 bonded to aluminum foil 34. Like the label, the side edges (not shown) of the liner overlap slightly along the helical line which may or may not be offset with regard to the butt joint 30. If offset the liner bridges the length of the butt joint 30 after the label is removed and is broken by striking the can down against the edge of a table.

At the time the tubular body of the can is formed, the collar cut 23 is made as described in the aforementioned patent. It is the collar cut that defines the lifting tab 24. When tab 24 is lifted at the time the container is to be opened, it will be seen as shown in FIG. 2 that the label 20 will separate from the clay release cleanly layer 24a which itself remains adhered to the adhesive 26.

It is an important feature of the invention in contrast with the prior art that little if any of the body stock material (certainly less than 10% of the surface fibers) is lifted from and removed with the label when the label is peeled back. Thus, it will be seen in both FIGS. 2 and 3 that the body stock layer remains almost entirely intact as does the label 20 itself. It is the intact removal of the label without removing the surface of the body stock layer 30 which provides for uniform reliable clean removal of the label so that no material is left which might make the butt joint 30 stronger in some places than in others and interfere with the full length opening of the can when it is struck against a solid object.

Once the label has been thus removed the can is struck manually against the edge of a table or other hard object. This causes the can to split along the butt joint 30 as the relatively thin layer 32–34 adjacent to the butt joint ruptures. The dough within the can can then be removed after first twisting the ends of the ruptured can body.

Figure 4:
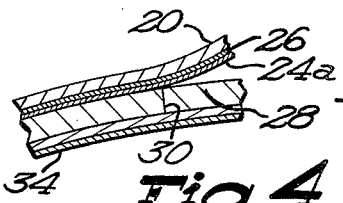
FIG. 4 is a view similar to FIG. 3 showing another form of the invention.

The modified form of the invention shown in FIG. 4 is just like FIG. 2 except that the clay coating **24*a* and adhesive layer 26 are reversed by applying the clay 24*a* to the kraft paper preferably before winding the can while the adhesive layer 26 is applied to the label or to the clay 24*a* preferably just as the can tube is wound. When the label is pulled up, the clay 24*a* separates from the kraft as shown. Thus, in both FIGS. 2 and 4 a particulate mineral layer is between the adhesive 26 and an adjacent layer which can be either the label as in FIG. 2 or the kraft layer as in FIG. 4** whereby removal of the label causes at least a portion of the mineral layer to peel away from the adjacent layer and at least a portion remaining adhered to the adhesive layer. This facilitates removal of the label without the surface of the body stock layer remaining adhered to the label.

Figure 3:
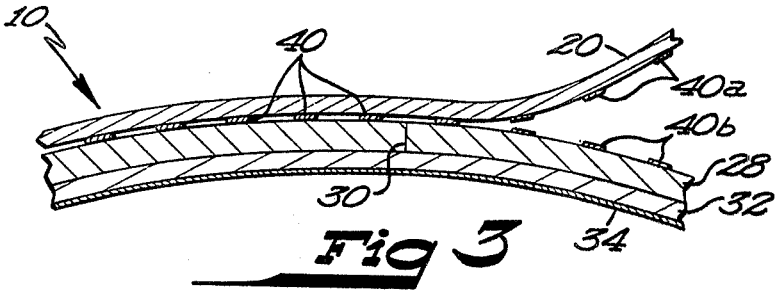
FIG. 3 is a partial horizontal sectional view of a portion of the can wall of a modified form of the invention.

Refer now to FIG. 3 which shows the modified form of the invention in which the same numerals refer to corresponding parts in FIGS. 1 and 2. The can of FIG. 3 is the same as the embodiments described above except that adhesive 40 replaces layers **24*a* and 26. The adhesive 40 in this instance comprises a frangible adhesive material composed of a multiplicity of small dots of adhesive applied by gravure printing or by means of an applicator roll having a doctor blade spaced closely thereto to control the thickness of the adhesive layer 40 on the applicator roll. When tab 24 is lifted, the label 20 as shown at the right in the figure is elevated from the underlying body stock 28 and the dots of adhesive 40 themselves break through their centers into pieces 40a and 40b. The frangible adhesive can comprise any of a variety of different adhesive compositions but preferably comprise a heavily filled resinous type aqueous emulsion wherein resin such as a polyvinyl acetate is dispersed in water together with a tackified alcohol. A typical formula is: clay 23%, water 68%, polyvinyl acetate 5%, tackified polyvinyl alcohol 4%. The filler can be any particulate filler, usually a mineral such as clay, silicon dioxide, asbestos, zinc oxide, calcium carbonate, talc, aluminum oxide powder, iron oxide powder, titanium dioxide powder, magnesium trisilicate powder, etc. The insert mineral filler provides two functions: it gives the adhesive thickness and body thereby increasing the viscosity. At the same time it reduces the peel strength of the adhesive by allowing it to split as shown in FIG. 3**.

The peel strength of the finished cans must be less than the tensile strength of the label to prevent nature thereof and for convenient use should be about 0.10 and 0.50 and preferably between about 0.15 to 0.30 pounds for a one inch wide strip of label peeled from the underlying body stock. The peel strength test is run with an Instron® tensile test machine with jaws moving at 12 inches per minute. In any event, the peel force must be less than the tensile strength of the label. While mineral fillers have been previously used in polyvinyl acetate type resin adhesives they are normally used in minor amounts, for example 10% or less. Whereas, in the present invention inert mineral filler is used in the amount of 15% or more by weight and preferably 15–25% by weight. All quantities herein are expressed in parts or percent by weight.

The adhesive described in connection with both FIGS. 2 and 3 provides excellent instant strength i.e. quick-tack to hold the freshly formed tube together during the forming operation. This characteristic is well known to those skilled in the art and can be determined by placing an adhesive between two test sheets of flexible material such as plastic film or paper and immediately drawing them apart. If the sheets stick together, the adhesive has what will be referred to herein as quick-tack. It also provides good bond strength after the cans have been formed but yet will allow the label 20 to be reliably removed when the tab 24 is lifted without causing the label or body stock to tear irregularly. The adhesive 40 as well as the clay layer **24*a* and adhesive layer 26 are both compatible with a variety of different kinds of kraft paper body layers 28. Moreover, the kraft layer 28** is lower in cost than the cylinder board previously used and the cans can be readily manufactured on existing equipment.

From the above description it will be seen that the mode of operation of the embodiments of FIGS. 1 and 2 depends upon the bond between the clay layer **24*a* and the label 20 being weaker than the bond between the clay layer 24*a* and adhesive layer 26. As a result, upon opening the container, the clay layer 24*a* transfers from the label 20 to the adhesive layer 26. On the other hand, the mode of operation of the embodiment of the FIG. 3 does not involve the transfer of layers but instead the splitting of a single layer, layer 40**.

While the invention has been described in connection with certain specific embodiments thereof, it should be understood that further modifications will suggest themselves to those skilled in the art and it is intended to cover such modifications as fall within the scope of the appended claims.

What is claimed is:

1. A fresh dough package comprising:

(a) a generally cylindrical can having a cylindrical body wall comprising a kraft paper body stock layer in strip form wound into a helix with its mating side edges defining a helically extending butt joint, (b) a liner formed from flexible sheet material against the inside surface of the body stock layer and overlapping the inner edge of the butt joint in the body stock layer, (c) a removable label layer peelably bonded to the outside surface of the kraft body stock layer, (d) said label layer having means therein defining a lifting tab, said lifting tab providing a means for withdrawing the label from the surface of the kraft body stock layer, (e) a peelable particulate mineral coating layer bonded between the label and the kraft body stock layer, (f) the removal of the label causing at least a portion of the particulate mineral layer to peel away from the adjacent body stock layer and at least a portion thereof to remain adhered to the label layer thereby facilitating the removal of the label without the surface of the body stock layer adhering to the label, (g) the peel strength of the bond between the label and the kraft body layer being between about 0.1 and 0.5 pounds per inch width of the label and also being less than the tensile strength of the label, thereby allowing removal of the label intact at least from the area of the butt joint to weaken the butt joint by an amount which is uniform throughout its length whereby the butt joint will have uniform opening characteristics throughout its length to facilitate opening the container at the butt joint, and (h) a circular end closure member sealed to at least one end of the tubular body wall of the container.

2. A fresh dough package comprising:

(a) a generally cylindrical can having a cylindrical body wall comprising a kraft paper body stock layer in strip form wound into a helix with its mating side edges defining a helically extending butt joint, (b) a liner formed from flexible sheet material against the inside surface of the body stock layer and overlapping the inner edge of the butt joint in the body stock layer, (c) a removable label layer peelably bonded to the outside surface of the kraft body stock layer, (d) said label layer having means therein defining a lifting tab, said lifting tab providing a means for withdrawing the label from the surface of the kraft body stock layer, (e) an adhesive layer bonded between the removable label layer and the kraft body stock layer, said adhesive having quick tack characteristics when freshly applied, (f) a second layer between the label layer and the kraft layer said second layer comprising a particulate mineral coating bonded between the adhesive and an adjacent layer whereby the removal of the label causes at least a portion of the mineral layer to peel away from the adjacent layer and at least a portion thereof to remain adhered to the adhesive layer facilitating the removal of the label without the surface of the body stock layer adhering to the label, (g) the peel strength of the bond between the label and the kraft body layer being between about 0.1 and 0.5 pounds per inch width of the label and also being less than the tensile strength of the label, thereby allowing removal of the label intact at least from the area of the butt joint to weaken the butt joint by an amount which is uniform throughout its length whereby the butt joint will have uniform opening characteristics throughout its length to facilitate opening the container at the butt joint, and (h) a circular end closure member sealed to at least one end of the tubular body wall of the container.

3. The package of claim 2 wherein substantially all of said second layer remains adhered to the adhesive layer after the label is removed.

4. The package of claim 2 wherein the mineral layer bonded to the adhesive comprises a clay coating.

5. The package of claim 4 wherein the clay coating comprises about 40 parts water and at least about 45 parts by weight of clay when applied.

6. The package of claim 1 wherein the label comprises a plastic resin film.

7. The package of claim 6 wherein the plastic resin film comprises a polystyrene film.

* * * * *